United States Patent [19]

Narayanan et al.

[11] Patent Number: 4,741,743

[45] Date of Patent: May 3, 1988

[54] GRINDING WHEEL WITH COMBINATION OF FUSED AND SINTERED ABRASIVE GRITS

[75] Inventors: Kesh S. Narayanan, Holden; Suresh S. Vagarali, Shrewsbury; Brian E. Swanson, Northborough, all of Mass.

[73] Assignee: Norton Company, Worcester, Mass.

[21] Appl. No.: 767,204

[22] Filed: Aug. 19, 1985

[51] Int. Cl.[4] ..... B24D 3/02

[52] U.S. Cl. ..... 51/309; 51/298

[58] Field of Search ..... 51/298, 309

[56] References Cited

U.S. PATENT DOCUMENTS

| | | | |
|---|---|---|---|
| 3,181,939 | 5/1965 | Marshall et al. | 51/309 |
| 3,454,385 | 7/1969 | Amero | 51/309 |
| 3,881,282 | 5/1975 | Watson | 51/309 |
| 3,891,408 | 6/1975 | Rowse et al. | 51/309 |
| 3,916,583 | 11/1975 | Rowse et al. | 51/309 |
| 4,126,429 | 11/1978 | Watson | 51/298 |
| 4,314,827 | 2/1982 | Leitheiser et al. | 51/298 |
| 4,457,767 | 7/1984 | Poon et al. | 51/298 |
| 4,543,107 | 9/1985 | Rue | 51/309 |
| 4,574,003 | 3/1986 | Gerk | 51/309 |

*Primary Examiner*—Paul Lieberman
*Assistant Examiner*—Willie J. Thompson
*Attorney, Agent, or Firm*—Rufus M. Franklin

[57] ABSTRACT

A combination of fused alumina grits with sintered gel alumina abrasive grits is shown to be more effective than either abrasive alone in cutting steel bars with bonded abrasive wheels at intermediate cutting speeds.

6 Claims, No Drawings

GRINDING WHEEL WITH COMBINATION OF FUSED AND SINTERED ABRASIVE GRITS

BACKGROUND OF THE INVENTION

The effectiveness of the material used as the abrasive grit in grinding wheels varies with the grinding conditions and the particular material being ground.

For example, cofused alumina zirconia abrasive made according to the teachings of U.S. Pat. No. 3,891,408 is very effective in grinding wheels for grinding 304 stainless steel and for grinding carbon steels at high metal removal rates, but is less effective, as compared to fused alumina, at slow grinding conditions.

The explanation for the different effectiveness of a given abrasive under differing grinding applications is often not clearly understood, but is related to the chemical composition, microstructure, and the related physical properties of the abrasive such as hardness, fracture toughness, impact strength, and thermal properties. Lack of such understanding makes difficult the prediction of the effectiveness of a given abrasive for a particular application in the absence of prior experience. Relatively new types of sintered abrasives made from dried alumina gels by sintering have been developed. One such type is that disclosed in U.S. Pat. No. 4,314,827. In particular, the embodiment of that invention disclosed in examples 19 to 29 (containing 4 to 8% MgO) is being produced on a commercial basis. Another alumina abrasive grit produced from a gel is disclosed is E.P.O. Application No. 85100506.6. That abrasive grit can be essentially pure alumina or may also contain MgO, and is made from gels which have been seeded with submicron alpha alumina particles.

The present invention relates to the combination, in grinding wheels, of the sintered alumina gel type abrasive with cofused alumina-zirconia abrasive.

SUMMARY OF THE INVENTION

The present invention resides in the discovery that cofused alumina zirconia abrasive grits mixed with aluminous abrasive grits made by gel sintering can result in a synergistic combination in a grinding wheel which performs better, at intermediate grinding rates, than either abrasive alone can achieve in the same grinding wheel.

While test results show that the sintered gel type abrasive can achieve superior results (as compared to the alumina zirconia abrasive) at low grinding speeds, and that the alumina zirconia abrasive can achieve superior results at high grinding speeds, it could not be predicted that, at intermediate grinding speeds, the combination would be more effective than either abrasive alone.

Grinding results indicate that the optimum results of the invention are when the ratio by volume of the abrasives is from 30/70 to 70/30, but that improved results may be achieved at 90/10 to 10/90 ratios.

Cofused alumina-zirconia (AZ) abrasives suitable for this invention are described in U.S. Pat. No. 3,181,939 and in U.S. Pat. No. 3,891,408. Abrasives having a near eutectic 35 to 50% zirconia, according to patent 3,891,408 are preferred, but cofused abrasive containing from 20 to 55% zirconia as disclosed in U.S. Pat. No. 3,181,939 can be employed. The preferred and optimum ratio of the two abrasives is from 30/70 volume ratio to 70/30 volume ratio, but advantageous also is the range from 10/90 to 90/10.

Not only is the product of this invention superior in efficiency at specific intermediate power levels, but it provides the opportunity to supply a wheel which while not optimum for all power levels, provides a good compromise and has the economic advantage of reducing the variety of wheels required to cover a wide range of operating conditions, thus reducing costs overall.

DETAILED DESCRIPTION OF THE INVENTION

Cold pressed 16×⅛×1" cut-off wheels were made containing 26.6 volume % epoxy modified phenolic resin, 10.1 volume % $FeS_2$, 10.1 volume % $K_2SO_4$ and 44.7 volume % abrasive. The abrasive blends studied here are given in Table 1. Both the abrasives, i.e. cofused alumina zirconia (40% zirconia) and sintered alumina gel (gel abrasive), had the same grit size (24 grit). These wheels, differing only in abrasive content, were cold pressed in a mold at approximately 600 tons and were cured in an oven at approximately 175° C. The wheels were tested on 2"×2" 1018 carbon steel. The results of the grinding test are given in Table II. The G ratio is defined as $$G = \frac{\text{Volume of Metal Removed}}{\text{Volume of Wheel Wear}}$$

and it gives an indication of the wheel life. The sintered alumina gel abrasive was a commercially available 5% $M_gO$ type, containing minor amounts of calcium as disclosed in published British Patent Application No. 2,099,012, of May 26, 1982.

The data shows that for 1018 carbon steel at 5 sec/cut (i.e., at high metal removal rate) AZ is more durable than the gel abrasive. The variation of G ratio vs. AZ abrasive content is sigmoidal in nature with G ratio beginning to level off for 67 AZ+33 gel blend. However, at 10 sec/out (i.e., slow grinding condition) exactly opposite behavior is observed with sintered gel type more durable than AZ. Again, the variation of G ratio is sigmoidal in nature with leveling off starting for 33 AZ+67 gel blend. Further, the grinding tests of Table II showed progressive increase in grinding power and burn with increase in AZ content of the blend. However, at 7 sec/cut (intermediate grinding condition), both 50 AZ+50 gel and 67 AZ+33 gel are more durable than either of the abrasives alone, and G ratio for 33 AZ+67 gel blend is nearly identical to that for 100% gel.

The data indicates that the optimum range for the AZ and sintered gel $Al_2O_3$ abrasive blends is 30 to 70% of both abrasives. Depending on the grinding conditions, the performance of grinding wheels containing these abrasive blends is either equal to or superior to the wheels containing either of the abrasives alone. Such a blended wheel is more versatile in servicing the cut-off market with a single wheel which can be efficiently used over a wide range of applications.

TABLE I

| AZ and XL Abrasive Blends | | |
|---|---|---|
| Wheel No. | AZ Volume % | Sintered Gel Volume % |
| 1 | 0 | 100 |
| 2 | 33 | 67 |
| *3 | 50 | 50 |
| 4 | 67 | 33 |

TABLE I-continued

| AZ and XL Abrasive Blends | | |
|---|---|---|
| Wheel No. | AZ Volume % | Sintered Gel Volume % |
| 5 | 100 | 0 |

TABLE II

| Results of Grinding Test (Grinding Ratios) | | | | |
|---|---|---|---|---|
| No. | Abrasive Blends (Vol. %) | 1018 Carbon Steel 5 sec/cut | 7 sec/cut | 10 sec/cut |
| 1 | 100% gel | 4.71 | 7.12 | 7.12 |
| 2 | 33 AZ + 67 gel | 5.48 | 7.12 | 6.55 |
| 3 | 50 AZ + 50 gel | 6.08 | 8.17 | 4.98 |
| 4 | 67 AZ + 33 gel | 7.46 | 7.77 | 3.46 |
| 5 | 100 AZ | 8.18 | 6.0 | 3.40 |

Four variations of sintered seeded alumina gels which are disclosed in co-pending U.S. patent application No. 06/662,869 were evaluated along with a ceramic coated fused alumina (U57A). The gel abrasive had different densities which are given in Table III. Cut-off wheels 16×⅛×1" were made with abrasive combinations of 100% U57A, 100% AZ alumina, 100% gel, 50% AZ+50% U57A and 50% AZ+50% gel. Grinding tests were conducted on 1.5 inch diameter 1018 carbon steel bars under constant feed rate conditions using three cut-rates, viz. 2.5, 3.5 and 5.0 sec/cut. The grinding ratios obtained are given in Table IV.

At fast cut-rates (2.5 and 3.5 sec.), AZ is more durable whereas at the slow cut-rate (5.0 sec.), U57A is more durable. For all the three cut-rates, G ratios of 50% AZ+50% U57A blend lie in between the values of the two abrasives alone. This data indicates that a synergistic effect of blending AZ with U57A abrasive does not exist.

The results are fairly consistent in that at high cut-rate (2.5 sec/cut), AZ is more durable whereas at the lowest cut-rate (5 sec/cut), gel has the higher G ratio. However, at the intermediate cut-rate (3.5 sec/cut), the abrasive blend of 50% AZ+50% gel has either higher or at least equal G ratio to either of the abrasives alone. For gels respectively, 50% AZ+50% gel blend is more durable than either of the two abrasives alone, and for gel Batch #168 50% NZ+50% gel is equal in G ratio to 100% gel. Hence, unlike its blends with U57A, AZ blends with gel abrasive are unique in that they show synergistic effects under certain grinding conditions. Further, the results obtained with gels are similar to those for the alumina with MgO gels.

Since at present, gel abrasives are more expensive than AZ, grinding wheels containing blends of AZ and gel are more cost/performance effective than those containing gel alone.

TABLE III

| Sintered Seeded Alumina from Gel | |
|---|---|
| Batch No. | Wax Density (gm/cc) |
| 166 | 3.71 |
| 167 | 3.78 |
| 168 | 3.90 |
| 169 | 3.95 |

TABLE IV

Average Grinding Ratios
Material: 1½ inch diameter 1018 carbon steel
Two wheels/cut rate/item

| Abrasive Variation | Time/Cut, Second 2.5 | 3.5 | 5.0 |
|---|---|---|---|
| 100% U57A | 3.61 ± 0.06 | 4.83 ± 0.22 | 5.75 ± 0.46 |
| 100% AZ | 5.04 ± 00 | 6.40 ± 0.19 | 4.21 ± 1.08 |
| 100% gel (#166) | 4.25 ± 00 | 5.58 ± 0.28 | 5.43 ± 0.14 |
| 100% gel (#167) | 4.43 ± 00 | 6.65 ± 0.41 | 5.08 ± 0.48 |
| 100% gel (#168) | 4.62 ± 0.20 | 7.02 ± 00 | 5.87 ± 0.32 |
| 100% gel (#169) | 5.28 ± 00 | 7.80 ± 0.29 | 6.21 ± 0.36 |
| 50% AZ + 50% U57A | 4.62 ± 00 | 6.08 ± 0.52 | 4.71 ± 0.10 |
| 50% AZ + 50% gel (#166) | 4.93 ± 0.11 | 7.03 ± 00 | 5.04 ± 0.23 |
| 50% AZ + 50% gel (#167) | 4.81 ± 00 | 7.02 ± 00 | 5.15 ± 0.13 |
| 50% AZ + 50% gel (#168) | 4.92 ± 0.11 | 7.01 ± 00 | 5.74 ± 0.46 |
| 50% AZ + 50% gel (#169) | 4.93 ± 0.11 | 8.09 ± 0.01 | 5.44 ± 0.41 |

What is claimed is:

1. A grinding wheel especially suitable for intermediate grinding speeds comprising abrasive grits bonded by an organic polymer bond in which the abrasive grits are a mixture of (1) cofused alumina-zirconia, containing 20 to 55% zirconia, and, (2) a sintered aluminous gel abrasive having a hardness of at least 13 on the Knoop scale, the ratio of (1) to (2) being in the range of from 30 to 70 to 70 to 30, by volume.

2. A grinding wheel as in claim 1 in which the abrasive (1) contains from 35 to 50% zirconia.

3. A grinding wheel as in claim 1 in which the abrasive (2) is essentially pure alumina.

4. A grinding wheel as in claim 1 in which abrasive is alumina with a minor amount of magnesia spinel.

5. A grinding wheel as in claim 1 in which the resin is a phenolic resin.

6. A grinding wheel as defined in claim 1 wherein the grinding ratio at intermediate power levels of the wheel driving motor is higher than the grinding ratio of the same wheel containing only abrasive (1) or abrasive (2) as the abrasive grit.

* * * * *

US004741743B1

REEXAMINATION CERTIFICATE (1887th)

United States Patent [19]

Narayanan et al.

[11] B1 4,741,743

[45] Certificate Issued Dec. 22, 1992

[54] GRINDING WHEEL WITH COMBINATION OF FUSED AND SINTERED ABRASIVE GRITS

[75] Inventors: Kesh S. Narayanan, Holden; Suresh S. Vagarali, Shrewsbury; Brian E. Swanson, Northborough, all of Mass.

[73] Assignee: Norton Company, Worcester, Mass.

Reexamination Request:
No. 90/002,309, Mar. 28, 1991

Reexamination Certificate for:

| | |
|---|---|
| Patent No.: | **4,741,743** |
| Issued: | **May 3, 1988** |
| Appl. No.: | **767,204** |
| Filed: | **Aug. 19, 1985** |

[51] Int. Cl.[5] ..... B24D 3/14
[52] U.S. Cl. ..... 51/309; 51/298
[58] Field of Search ..... 51/307, 309

[56] References Cited

U.S. PATENT DOCUMENTS

| | | | |
|---|---|---|---|
| 2,455,358 | 12/1948 | Diterichs | 501/153 |
| 3,108,888 | 10/1963 | Bugosh | 106/62 |
| 4,166,099 | 8/1979 | McDaniel et al. | 423/329 |
| 4,181,532 | 1/1980 | Woodhead | 106/40 R |
| 4,314,827 | 2/1982 | Leitheiser et al. | 51/298 |

OTHER PUBLICATIONS

"Enhanced Densification of Boehmite Sol-Gels by α-Alumina Seeding", Kumagai et al., *Communications of the American Ceramic Society*, Nov. 1984.

"Cubitron® Ceramic Alumina Abrasive Grain", Dr. Philip E. Kendall, Gorham Advanced Materials Institute, Dec. 10-12, 1989.

Ervin, G., Jr. "Alumina and its Hydrates" The Pennsylvania State College PHd Thesis 1949.

"Nucleation and Epitaxial Growth in Diphasic Gels" Roy et al.—1986 *Science of Ceramic Chemical Processing* Wiley & Sons, pp. 247-258.

*Primary Examiner*—William R. Dixon, Jr.

[57] ABSTRACT

A combination of fused alumina grits with sintered gel alumina abrasive grits is shown to be more effective than either abrasive alone in cutting steel bars with bonded abrasive wheels at intermediate cutting speeds.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–6, dependent on an amended claim, are determined to be patentable.

1. A grinding wheel especially suitable for intermediate grinding speeds comprising *first and second* abrasive grits [bonded by] *in* an organic polymer bond [in which the abrasive grits are a mixture of] *wherein said first and second grits are respectively:*

(1) cofused alumina-zirconia, containing 20 to 55% zirconia, and, (2) a sintered [aluminous] *seeded* gel *alumina* abrasive having a hardness of at least 13 on the Knoop scale, the ratio of (1) to (2) being in the range from 30 to 70 to 70 to 30, by volume.

* * * * *